US008759700B2

(12) United States Patent
Yashima

(10) Patent No.: US 8,759,700 B2
(45) Date of Patent: Jun. 24, 2014

(54) PUSH SWITCH AND METHOD OF MANUFACTURING THE SAME

(75) Inventor: Tetsushi Yashima, Isesaki (JP)

(73) Assignee: Tokyo Parts Industrial Co., Ltd., Gunma-ken (JP)

( * ) Notice: Subject to any disclaimer, the term of this patent is extended or adjusted under 35 U.S.C. 154(b) by 259 days.

(21) Appl. No.: 13/200,734

(22) Filed: Sep. 29, 2011

(65) Prior Publication Data

US 2012/0160647 A1 Jun. 28, 2012

(30) Foreign Application Priority Data

Dec. 22, 2010 (JP) ..... 2010-285481

(51) Int. Cl.
*H01H 13/06* (2006.01)

(52) U.S. Cl.
USPC ..... 200/341; 200/302.2

(58) Field of Classification Search
USPC ..... 200/341, 302.2, 293–296
See application file for complete search history.

(56) References Cited

U.S. PATENT DOCUMENTS

| | | | | |
|---|---|---|---|---|
| 6,462,291 | B1 * | 10/2002 | Sachs | 200/302.2 |
| 7,046,136 | B2 * | 5/2006 | Sugimoto et al. | 340/539.1 |
| 7,230,196 | B2 * | 6/2007 | Toyama | 200/314 |
| 7,764,930 | B2 * | 7/2010 | Taira et al. | 455/69 |
| 8,044,313 | B2 * | 10/2011 | Yamamoto | 200/314 |
| 8,242,390 | B2 * | 8/2012 | Prest et al. | 200/5 A |
| 8,575,506 | B2 * | 11/2013 | Kitahara et al. | 200/341 |

FOREIGN PATENT DOCUMENTS

JP 2008-010360 1/2008

* cited by examiner

*Primary Examiner* — Xuong Chung Trans
(74) *Attorney, Agent, or Firm* — Jordan and Hamburg LLP

(57) ABSTRACT

A push switch comprising: a button made of a flexible material having a cap shaped top operation part, a flat part formed extending laterally from an edge of an opening in the top operation part, and a side wall formed extending downward from an outer edge of the flat part; a switch substrate fitted in close contact with the inner circumference of the side wall and abutting the bottom face of the flat part of the button; and a switch arranged inside the button, on the switch substrate, wherein the outer circumferential face of the side wall of the button and the bottom face of the switch substrate are covered by integrally molded resin.

6 Claims, 10 Drawing Sheets

PUSH SWITCH AND METHOD OF MANUFACTURING THE SAME

BACKGROUND OF THE INVENTION

1. Field of the Invention

The present invention relates to a push switch.

2. Description of the Related Art

Conventional push switches include, for example, switch operation devices that are installed in vehicles and operated by pressing from the exterior (Japanese Patent Laid-Open Publication No. 2008-10360). As shown in FIG. 10(*a*) and FIG. 10(*b*), this push switch comprises a switch case 101, made from hard resin, a switch button 102, made from soft resin, and a main switch unit 107.

This switch case 101 is formed as a rectilinear box having a space at the interior for receiving the switch button 102. The main switch unit 107 is assembled at the interior of the switch button 102, and a thermosetting resin 111 is applied at the interior of the switch case 101. This thermosetting resin 111 solidly fixes the main switch unit 107 in place in the switch case 101 and the switch button 102, and allows for waterproofing of the main switch unit 107.

However, in methods where the resin is applied (injected) into the switch case, it is difficult to fill the interior of the switch case without gaps, and thus gaps may occur between the resin and the inner side of the switch case. In this event, if drops of water adhere to the bottom of the switch case, there is a risk that these drops of water will infiltrate the main switch unit, which reduces the waterproofness of the push switch.

Furthermore, the work of applying the thermosetting resin requires much time and skill, which greatly reduces productivity.

SUMMARY OF THE INVENTION

Thus, the present invention provides a push switch with which the waterproofness of the push switch can be improved, and with which productivity can be improved.

In order to achieve the aforementioned objective, the push switch of the present invention comprises a button made of a flexible material having a cap shaped top operation part, a flat part formed extending laterally from an edge of an opening in said top operation part, and a side wall formed extending downward from an outer edge of said flat part. A switch substrate is mounted in close contact with the inner circumference of the side wall and abuts the bottom face of the flat part of the button. A switch is arranged inside the button, on the switch substrate, wherein the outer circumferential face of the side wall of the button and the bottom face of the switch substrate or a region below the switch substrate are covered by integrally molded resin.

In the present invention, the bottom edge of the side wall of the button, extends further downward than the switch substrate.

The present invention also relates to a method of manufacturing the push switch comprising the steps of arranging the switch substrate bearing the switch within the button, inserting the button, in which the switch substrate is arranged, into a primary forming mold, and integrally molding an outer wall at the external circumferential face of the side wall of the button; and inserting the button, wherein the outer wall has been integrally molded, into a secondary forming mold, and integrally molding a bottom wall on the bottom face of the switch substrate.

The present invention also relates to a method of manufacturing the push switch comprising the steps of arranging the switch substrate bearing the switch within the button inserting the button, in which the switch substrate is arranged, into a primary forming mold, and integrally molding a first bottom wall on the bottom face of the switch substrate; and inserting the button, wherein the first bottom wall has been integrally molded, into a secondary forming mold, and integrally molding an outer wall and a second bottom wall at the outer circumferential face of the side wall of the button and on the bottom face of the first bottom wall.

The present invention also relates to a method of manufacturing the push switch comprising the steps of arranging the switch substrate bearing the switch within said button fitting a stopper on the bottom face of the switch substrate within the button; and inserting the button, wherein the stopper has been fitted, into a forming mold, and integrally molding an outer wall and a bottom wall at the outer circumferential face of the side wall of the button and on the bottom face of the switch substrate.

With the present invention, the outer circumferential face of the side wall of the button and the bottom of the switch substrate or a region below the switch substrate are covered by integrally molded resin. Thus the interior of the button is sealed and reliable waterproofing can be achieved. Furthermore, the conventional work of injecting thermosetting resin is not required, so that the time required for assembly can be greatly reduced and productivity can be markedly improved.

BRIEF DESCRIPTION OF THE DRAWINGS

FIG. 10(*b*) is a view showing the situation in which the main switch unit has been assembled at the interior of the switch button but the thermosetting resin has not yet been applied via the bottom of the switch case.

DESCRIPTION OF THE PREFERRED EMBODIMENTS

Hereafter, modes of embodiment of the present invention are described with reference to the drawings.

First Mode of Embodiment

Figure 1:
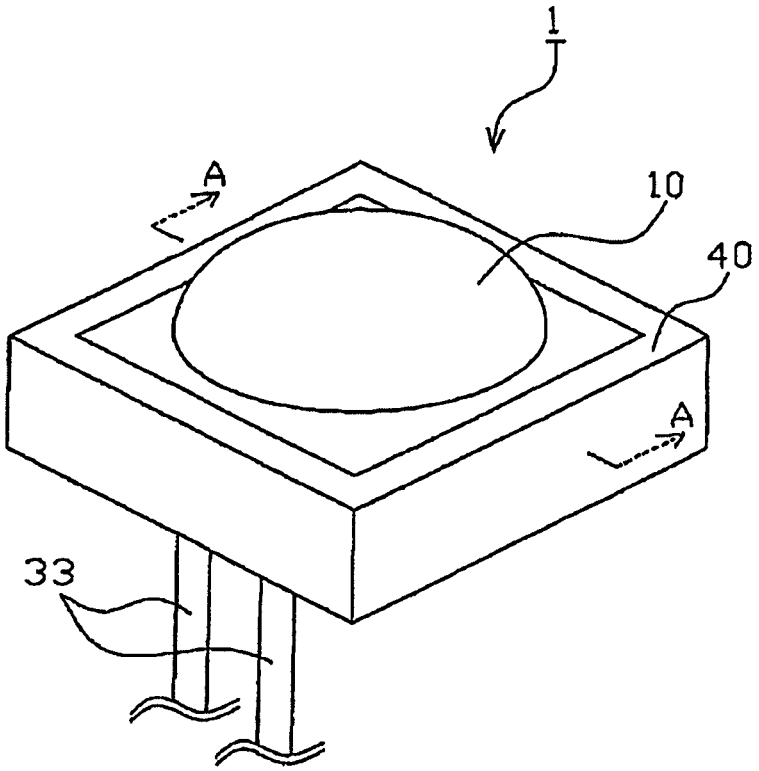
FIG. 1 is a perspective view of a completed push switch according to a first mode of embodiment of the present invention.
Figure 2:
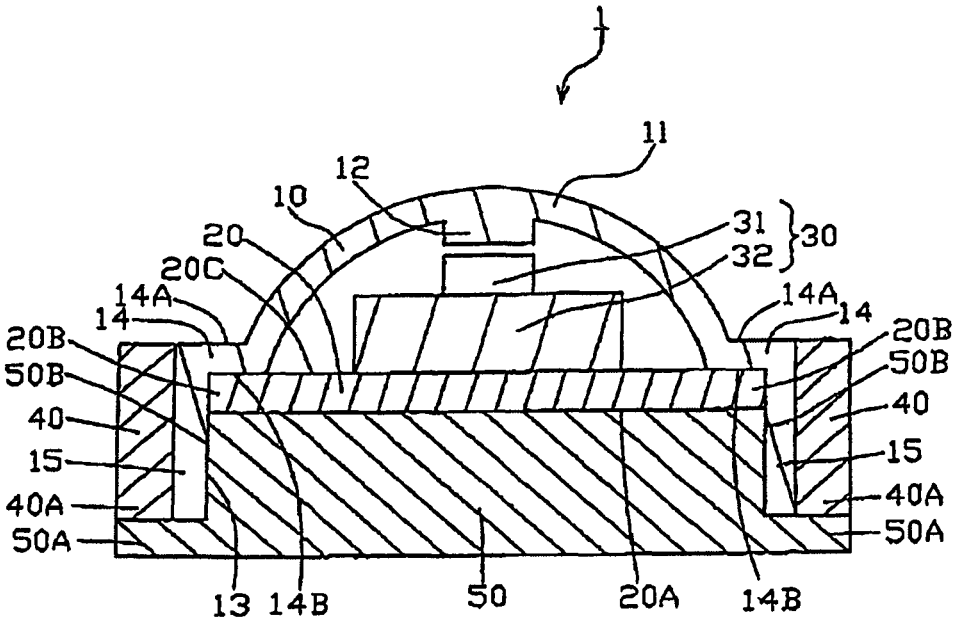
FIG. 2 is a sectional view according to the section line A-A in FIG. 1, in accordance with the first embodiment of the present invention.

FIG. 1 is a perspective view of a completed push switch according to a first mode of embodiment of the present invention. FIG. 2 is a sectional view according to the section line A-A in FIG. 1, in accordance with the first embodiment of the present invention. As shown in FIG. 2, the push switch 1 in this mode of embodiment comprises a button 10, a switch substrate 20, a switch 30, an outer wall 40 and a bottom wall 50.

The push switch 1 in this mode of embodiment is installed in an opening in a vehicle door handle device, which is not illustrated. The push switch 1 is mounted in the opening in the door handle device so that the button 10 thereof is exposed at the exterior. When the button 10 is pressed by the finger of a vehicle user or the like, the door can be locked or unlocked.

The button 10 covers the switch 30 and, as shown in FIG. 2, is integrally molded from soft resin. This button 10 comprises cap shaped top operation part 11, which protrudes to the exterior of the door from the opening in the door handle device, a push part 12 that protrudes downwards from the top operation part 11, a flat part 14 that extends laterally from the edge of the opening in the top operation part 11, and a side wall 15 that extends downwards from the outer edge of the flat part 14. The side wall 15 has an rectangular cylinder shaped opening 13. The soft resin from which the button 10 is made may be an elastomer resin or a synthetic rubber, and silicone rubber is preferred. Furthermore, the cap shape of the top operation part 11 is preferably dome shaped, but this may also be a bottomed cylinder or a bottomed rectangle.

The switch substrate 20 serves to mount the switch 30. The switch substrate 20 is formed from a thin sheet of glass-epoxy substrate having a planar face 20C. The external shape of the switch substrate 20 is substantially the same as the inner shape of the opening 13 in the button 10. This switch substrate 20 abuts a bottom face 14B of the flat part within the button 10, and is fitted in close contact with the inner circumference of the side wall 15 of the button 10. Furthermore, the top face 14A of the flat part of the button 10 and the periphery 20B of the switch substrate are arranged so that at least portions thereof overlap in a direction perpendicular to the planar face 20C of the switch substrate 20.

The switch 30 serves to convert the vehicle user's intention to lock or unlock the lock into an electrical signal. The switch 30 is arranged on the switch substrate 20, within the button 10. The switch 30 comprises an operation part 31, a main unit 32, and terminals, which are not illustrated. The operation part 31 of the switch 30 is arranged facing the push part 12 of the button 10.

The terminals of the switch 30 are connected to the switch substrate 20 by way of soldering. The operation part 31 of the switch 30 is biased in the direction that is upward in FIG. 2. If the operation part 31 is pressed in the direction that is downward in FIG. 2, a click can be felt, and conduction occurs between contacts, which are not illustrated. When the pressing force is released from the operation part 31, it returns to the original state, and there is no conduction between the contacts. The switch 30 can be opened and closed in this manner. The signal from this switch 30 is transmitted to the exterior via lead wires 33 that are mounted on the bottom of the switch substrate 20.

The outer wall 40 is molded from resin as a rectangular cylinder, at the outer peripheral face of the side wall 15 of the button 10. This outer wall 40 is integrally molded, with the button 10, including the switch substrate 20, inserted in a primary forming mold 62A, which is described hereafter. The primary forming mold 62A comprises a cavity mold 60A and a core mold 61A, which are described hereafter in conjunction with FIG. 3, and can be opened and closed in the vertical direction. One end of the outer wall 40 (the top end in FIG. 2) is the same height as the flat part 14 of the button. The other end of the outer wall 40 (the bottom end in FIG. 2) is the same height as the open end of the opening 13 in the button 10.

The bottom wall 50 is integrally molded from resin on the bottom face 20A of the switch substrate. This bottom wall 50 is integrally molded, with the button 10, including the switch substrate 20, inserted in a secondary forming mold 62B, which is described hereafter. The secondary forming mold 62B comprises a cavity mold 60B and a core mold 61B, which are described hereafter in conjunction with FIG. 3, and can be opened and closed in the vertical direction. The periphery 50A of the bottom end of the side face of the bottom wall 50 is joined (sealed) by way of integral molding all around the bottom end 40A of the outer wall, as shown in FIG. 2. Consequently, the outer wall 40 and the bottom wall 50 constitute a single molded resin body, and the outer circumferential face of the side wall 15 of the button 10 and the bottom face of the switch substrate 20 are covered by integrally molded resin.

In the present invention, there are no particular restrictions on the material for the resin that is used for the outer wall 40 and the bottom wall 50, but resin with good weatherproof characteristics is preferred. This may be an ordinary thermoplastic resin, and resins such as polypropylene (PP) and polyacetal (POM) are preferred. Furthermore, the material for the resin used for the outer wall 40 and the bottom wall 50 may be a soft or hard hot-melt resin. Hot melt resins are solid or viscous at room temperature and when heated and melted become fluid or liquid. These hot melt resins melt at lower temperatures and can be molded at lower pressures than ordinary thermoplastic resins. Furthermore, the material for the resin used for the outer wall 40 and the bottom wall 50 may be a thermosetting resin such as a phenol resin (PF) or an epoxy resin (EP).

Next, a method of manufacturing the push switch 1 of this mode of embodiment is described.

Figure 3:
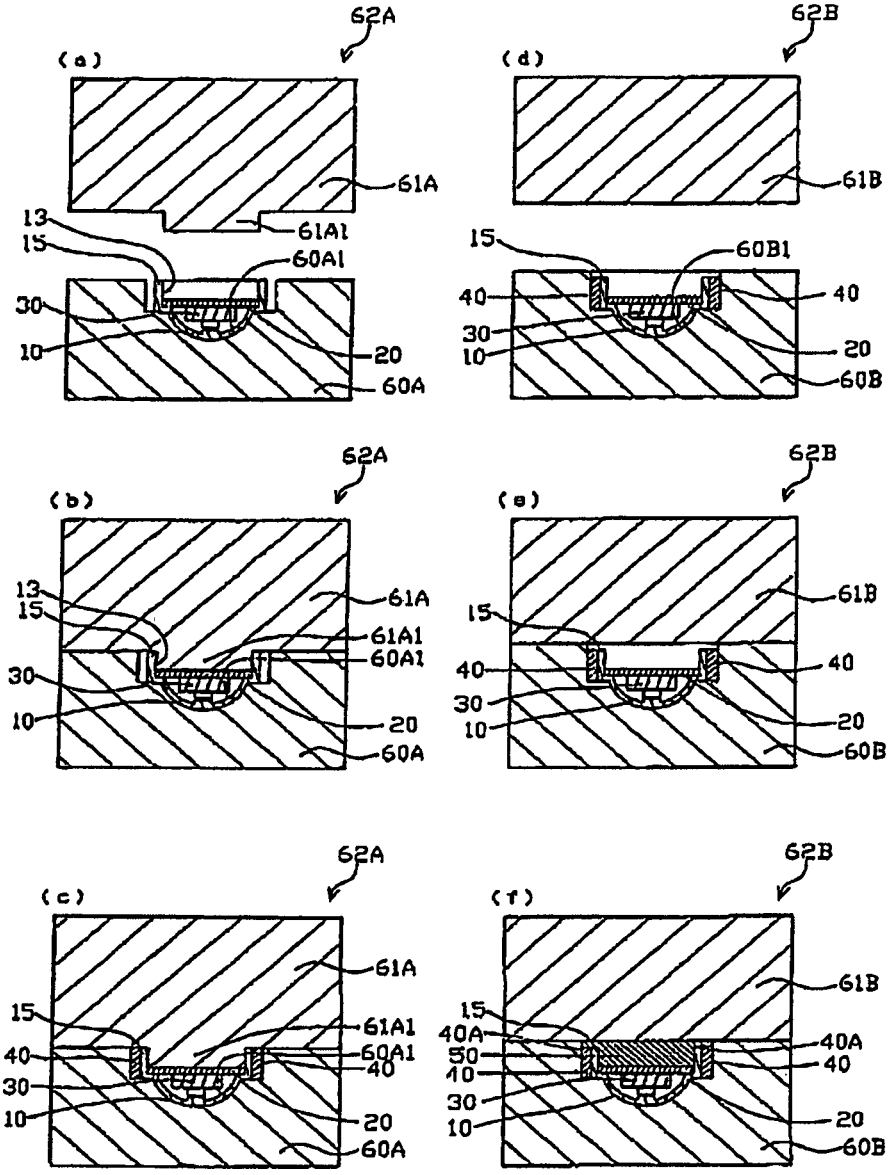
FIG. 3 consists of sectional views showing the manufacturing steps for the push switch according to the first mode embodiment of the present invention.

FIG. 3(*a*) is a sectional view showing the situation in which the button including the switch substrate has been inserted into the primary forming mold according to the first mode of embodiment of the present invention. FIG. 3(*b*) is a sectional view of the situation in which the primary forming mold according to the first mode of embodiment of the present invention has been closed. FIG. 3(*c*) is a sectional view of the situation in which the resin has been injected into the primary forming mold according to the first mode of embodiment of the present invention. FIG. 3 (*d*) is a sectional view showing the situation in which the button from FIG. 3(*c*) has been inserted into the secondary forming mold according to the first mode of embodiment of the present invention. FIG. 3(*e*) is a sectional view of the situation in which the secondary forming mold according to the first mode of embodiment of the present invention has been closed. FIG. 3(*f*) is a sectional view of the situation in which the resin has been injected into secondary forming mold according to the first mode of embodiment of the present invention.

First, the lead wires 33 are soldered to the switch substrate 20 bearing the switch 30. Then, the switch substrate 20 bearing the switch 30 is arranged inside the button 10. This button 10 is inserted into the primary forming mold 62A, which comprises the cavity mold 60A and the core mold 61A, and which can be opened and closed (see FIG. 3(*a*)). The bottom of a recess 60A1 of the cavity mold is the same shape as the top operation part 11 of the button 10. The inner face of the recess 60A1 of the cavity mold is larger than the external circumferential face of the side wall 15 of the button.

Furthermore, when the top operation part 11 of the button 10 is fitted in the bottom of the recess 60A1 of the cavity mold (see FIG. 3(*a*)), the height of the recess 60A1 of the cavity mold is the same as the height of the side wall 15 of the button 10. Accordingly, the height of the parting line between the cavity mold 60A and the core mold 61A is the same as that of opening end of the opening 13 in the button 10. Furthermore, a protrusion 61A1 is provided on the core mold 61A, which has a slightly smaller external shape than the inner shape of the opening 13 in the button 10. When the primary forming mold 62A is closed, the forward end of the protrusion 61A1 abuts the bottom face 20A of the switch substrate 20 and applies pressure.

When the primary forming mold 62A is closed (see FIG. 3(*b*)), the protrusion 61A1 of the core mold 61A is inserted into the opening 13 in the button 10. In this state, molten resin is injected into the space between the inner face of the recess 60A1 of the cavity mold and the side wall 15 of the button 10 (see FIG. 3(*c*)). Thus, the outer wall 40 is integrally molded at the outer circumferential face of the side wall 15 of the button 10 (primary forming).

Next, the button 10 wherein the outer wall 40 is integrally molded is inserted into the secondary forming mold 62B, which comprises the cavity mold 60B and the core mold 61B, and which can be opened and closed (see FIG. 3 (*d*)). The bottom of a recess 60B1 of the cavity mold is the same shape as the top operation part 11 of the button 10. The inner face of the recess 60B1 of the cavity mold is formed so as to contact the outer wall 40 that is provided on the button 10. When the top operation part 11 of the button 10 is fitted in the bottom of the recess 60B1 of the cavity mold (see FIG. 3 (*d*)), the height (depth) of the recess 60B1 of the cavity mold is greater than the side wall 15 of the button 10. The bottom of the core mold 61B, which contacts the cavity mold 60B, is flat.

Then, with the secondary forming mold 62B closed (see FIG. 3(*e*)), molten resin of the same type as the outer wall 40 is injected into the button 10. Thus, the bottom wall 50 is integrally molded on the bottom face 20A of the switch substrate (secondary forming), the periphery 50A at the bottom end of the side of the bottom wall 50 is joined with the bottom end 40A of the outer wall 40 (see FIG. 2), and the push switch 1 is completed (see FIG. 3(*f*)).

The push switch of this mode of embodiment, which is configured in this manner, can entirely eliminate the problems of reduced waterproofing when water drops have adhered to the bottom of the button and decreased productivity owing to the work of applying the thermosetting resin.

In other words, with the present mode of embodiment, the outer circumferential face of the side wall 15 of the button 10 and the bottom face 20A of the switch substrate are covered with integrally molded resin. Consequently, gaps do not form as was conventional, and the space within the cap shaped top operation part 11, in which the switch 30 is arranged, can be reliably sealed by the resin. Accordingly, even if water drops adhere to the push switch, the water drops will not adhere to the switch by way of the interior of the button, allowing for reliable waterproofing, which results in a reliable push switch.

Furthermore, the outer circumferential face of the side wall 15 of the button 10 and the bottom face 20A of the switch substrate are covered with resin. Consequently, there is no need for the conventional work of injecting thermosetting resin, and thus the time required for assembly work can be greatly reduced and productivity can be markedly improved.

Furthermore, the button 10 comprises a cap shaped top operation part 11, a flat part 14 that is formed extending laterally from the opening end of the top operation part 11, and a side wall 15 that is formed extending downwards from the outer edge of the flat part 14. Furthermore, the switch substrate 20 abuts the bottom face 14B of the flat part of the button 10, and is fitted in close contact with the inner circumference of the side wall 15 of the button 10.

With such a configuration, when the outer wall 40 is molded from resin (primary forming), upon closing the primary forming mold 62A, the protrusion 61A1 of the core mold pushes against the forming mold (cavity mold 60A) via the switch substrate 20, deforming the flat part 14 of the button 10. Consequently, the top face 14A of the flat part of the button 10 is pressed against the cavity mold 60A. Thus, when the pressurized molten resin is injected into the space between the inner face of the recess 60A1 of the cavity mold and the side wall 15 of the button 10 by way of injection molding, the molding can be accomplished without resin burrs forming between the top face 14A of the flat part of the button 10 and the cavity mold 60A.

Furthermore, when the bottom wall 50 is molded from resin (secondary forming), the pressurized molten resin flows onto the bottom face 20A (in the opening 13 of the button 10) by way of injection molding. At this point, the pressure of the molten resin is applied to the secondary forming mold (cavity mold 60B) via the switch substrate 20, deforming the flat part 14 of the button 10. Consequently, because the bottom face 14B of the flat part of the button 10 and the periphery 20B of the switch substrate are pressed together, the molten resin does not enter the top operation part 11 of the button 10.

Accordingly, molding can be performed with high reproducibility, allowing a highly reliable waterproof push switch to be produced.

Furthermore, the outer wall 40, which is integrally molded from resin, is provided at the external circumferential face of the side wall 15 of the button 10. Thereafter, the bottom wall 50, which is integrally molded from the same resin as the outer wall 40, is provided on the bottom face 20A of the switch substrate. The periphery 50A of the bottom edge of the side of the bottom wall 50 is joined with the bottom end 40A of the outer wall. By molding in this manner, the molding can be performed without deforming the soft resin side wall of the button. Furthermore, the outer wall 40 and the bottom wall 50 are formed from the same resin. Consequently, even if endurance tests (for example, heat shock tests) are performed, because the thermal expansion ratios of the molded resins are the same, gaps will not occur between the outer wall and the bottom wall owing to thermal deformation of the molded resin. Thus, it is possible to produce a highly reliable push switch, with which the waterproofing is more reliable.

Furthermore, to describe the present mode of embodiment in more concrete terms, the bottom edge of the side wall 15 of the button 10 extends further downward than the switch substrate 20, so that the switch substrate 20 is surrounded by the opening 13 in the button 10. Accordingly, resin is integrally molded in the opening in the button on the bottom of the switch substrate. Consequently, the side face of the bottom wall can reliably adhere to the interior of the opening in the button (inner face of the side wall 15), so that waterproofness can be further improved. Furthermore, because the side wall of the button is trapped between the bottom wall and the outer wall by way of integral molding, the soft button can be reliably fixed in place.

Figure 4:
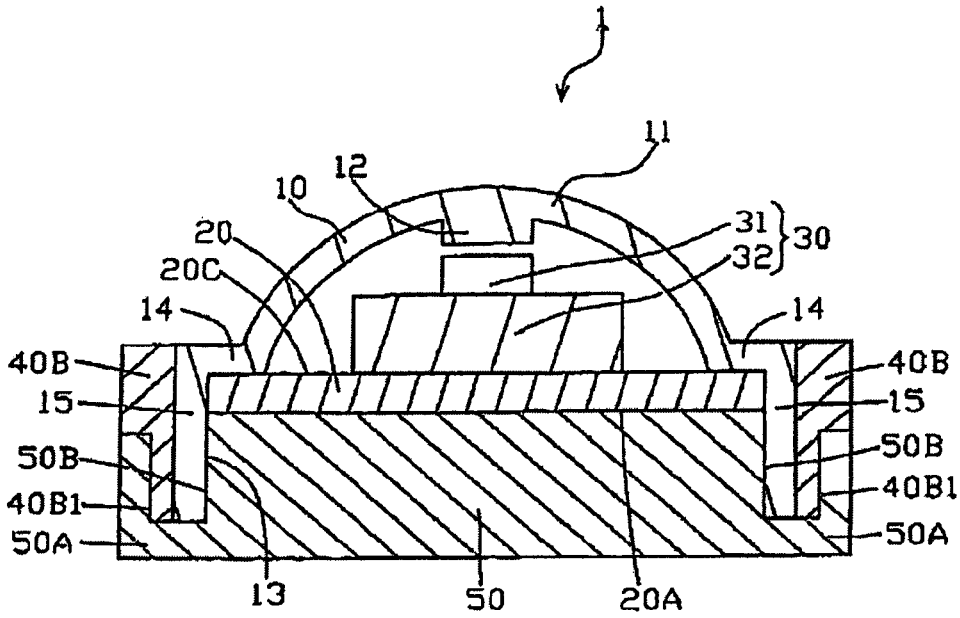
FIG. 4 shows a variant of the push switch of the first mode embodiment of the present invention.

Next, FIG. 4 shows a variant of the push switch of the first mode embodiment of the present invention.

The outer circumferential bottom end of the outer wall 40B may be provided with a cutaway 40B1, as shown in FIG. 4. In this case, the joining area between the outer wall 40B and the periphery of the bottom wall 50 is increased, improving the joining strength, and allowing a highly reliable push switch to be produced, with which reliable waterproofing can be produced.

Second Mode of Embodiment

Figure 5:
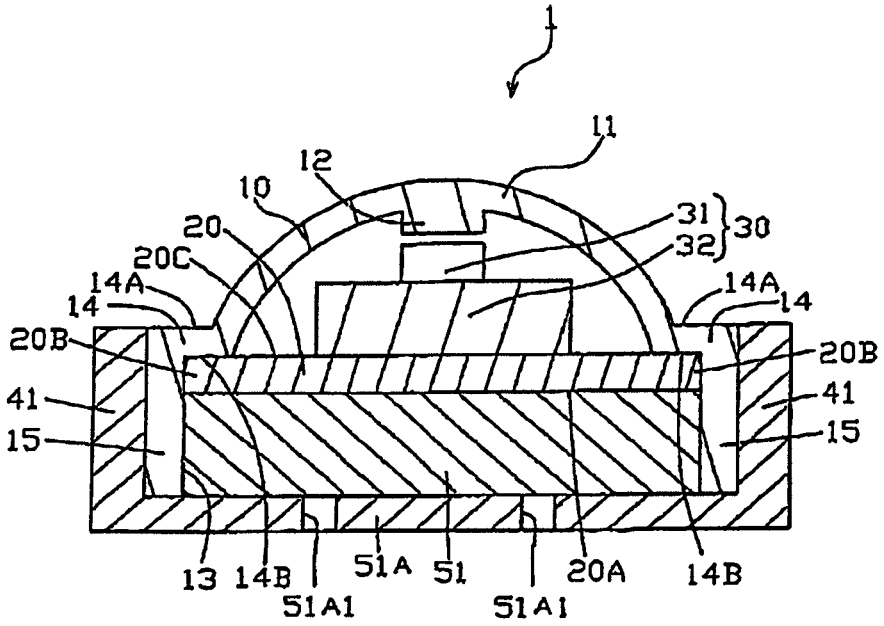
FIG. 5 is a sectional view of a push switch according to a second mode of embodiment of the present invention.

FIG. 5 is a sectional view of a push switch according to a second mode of embodiment of the present invention.

Figure 6:
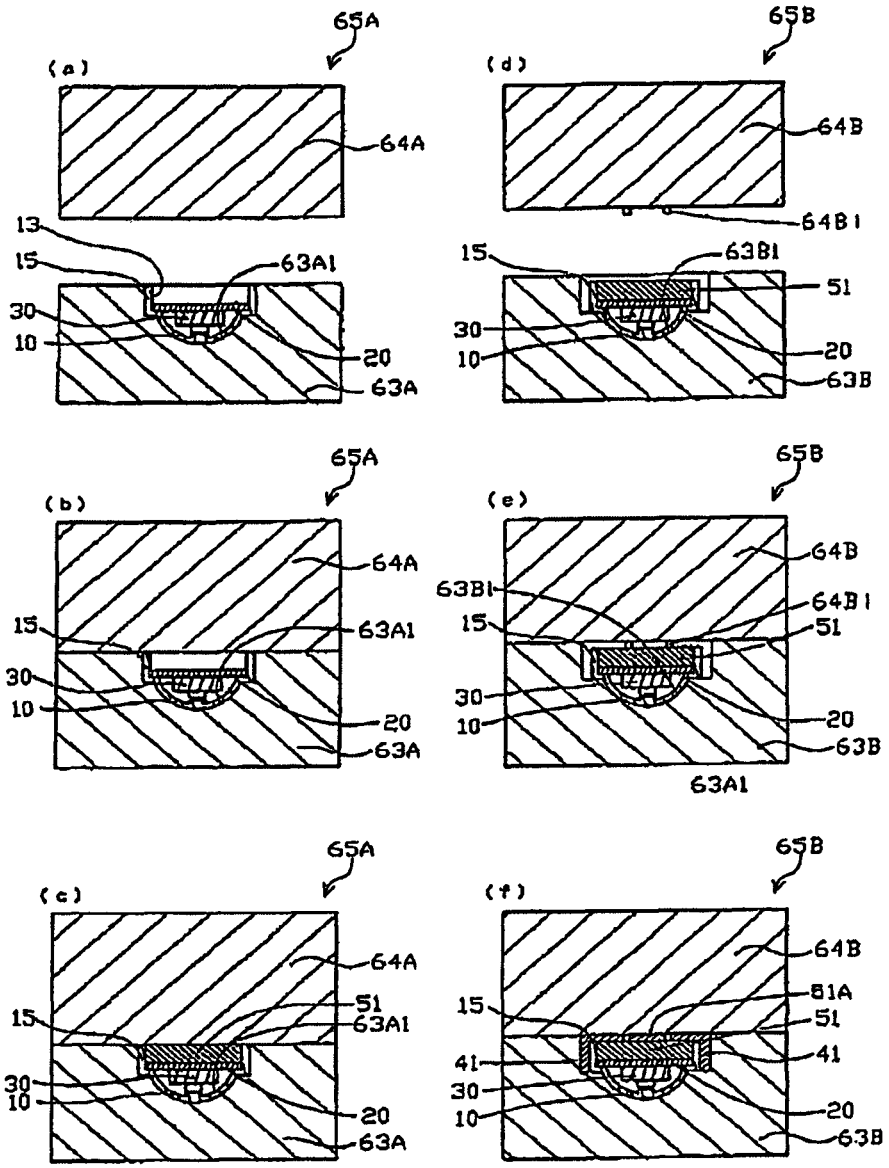
FIG. 6 consists of sectional views showing the manufacturing steps for the push switch according to the second mode of embodiment of the present invention.

FIG. 6(*a*) is a sectional view showing the situation in which the button including the switch substrate has been inserted into the primary forming mold according to the second mode of embodiment of the present invention. FIG. 6(*b*) is a sectional view of the situation in which the primary forming mold according to the second mode of embodiment of the present invention has been closed. FIG. 6(*c*) is a sectional view of the situation in which the resin has been injected into the primary forming mold according to the second mode of embodiment of the present invention. FIG. 6 (*d*) is a sectional view showing the situation in which the button from FIG. 6(*c*) has been inserted into the secondary forming mold according to the second mode of embodiment of the present invention. FIG. 6(*e*) is a sectional view of the situation in which the secondary forming mold according to the second mode of embodiment of the present invention has been closed. FIG. 6(*f*) is a sectional view of the situation in which the resin has been injected into the secondary forming mold according to the second mode of embodiment of the present invention. In FIG. 5 and FIG. 6, identical reference numerals have been used for components identical to those in the first mode of embodiment, and redundant description of the same has been omitted.

The differences between the present mode of embodiment and the first mode of embodiment will be explained. In the first mode of embodiment, the button 10, in which the switch substrate 20 has been arranged, is inserted into the primary forming mold 62A, and the outer wall 40 is integrally molded on the outer circumferential face of the side wall 15 of the button 10. Then, this button 10 is inserted into the secondary forming mold 62B, and the bottom wall 50 is integrally molded on the bottom face 20A of the switch substrate. Conversely, in the present mode of embodiment, the button 10, in which the switch substrate 20 has been arranged, is inserted into the primary forming mold 65A, and a first bottom wall 51 is integrally molded on the bottom face of the switch substrate 20. Then, the button 10, wherein the first bottom wall 51 has been integrally molded, is inserted into the secondary forming mold 65B, and an outer wall 41 and a second bottom wall 51A are integrally molded on the outer circumferential face of the side wall 15 of the button 10 and bottom face of the first bottom wall 51.

That is to say, a first bottom wall 51 that is integrally molded from resin is provided on the bottom face 20A of the switch substrate. Furthermore, the outer wall 41 and the second bottom wall 51A are integrally molded on the outer circumferential face of the side wall 15 of the button 10 and the bottom face of the first bottom wall 51. The second bottom wall 51A is provided joined to (adhering to) the bottom face of the first bottom wall 51. The resin of the outer wall 41 and the second bottom wall 51A is the same as the resin of the side wall 15 and the first bottom wall 51.

Next, the assembly procedure for the push switch 1 of this mode of embodiment is described.

First, the lead wires 33 are soldered to the switch substrate 20 bearing the switch 30. Then, the switch substrate 20 bearing the switch 30 is arranged inside the button 10. This button 10 is inserted into a primary forming mold 63A, which comprises a cavity mold 63A and a core mold 64 A, and which can be opened and closed (see FIG. 6(*a*)). The bottom of a recess 63A1 of the cavity mold is the same shape as the top operation part 11 of the button 10. The inner face of the recess 63A1 in the cavity mold is the same shape as the external circumferential face of the side wall 15 of the button.

When the top operation part 11 of the button 10 is fitted in the bottom of the recess 63A1 in the cavity mold (see FIG. 6((*a*)), the height of the recess 63A1 in the cavity mold is the same as the height of the side wall 15 of the button 10. Accordingly, the height of the parting line between the cavity mold 63A and the core mold 64A is the same as the height of the opening end of the opening 13 in the button 10. The bottom of the core mold 64A, which contacts the cavity mold 63A, is flat.

Then, with the primary forming mold 65A closed (see FIG. 6(*b*)), the molten resin is injected into the button 10 (see FIG. 6(*c*)), and the first bottom wall 51 is integrally molded on the bottom face 20A of the switch substrate (primary forming).

Next, the button 10 wherein the first bottom wall 51 has been integrally molded is inserted into the secondary forming mold 65B, which comprises the cavity mold 63B and the core mold 64B, and which can be opened and closed. The bottom of a recess 63B1 in the cavity mold is the same shape as the top operation part 11 of the button 10. The inner face of the cavity mold 63B is larger than the side wall 15 of the button 10. When the top operation part 11 of this button 10 is fitted in the bottom face of the recess 63B1 in the cavity mold (see FIG. 6 (*d*)), the height (depth) of the recess 63B1 in the cavity mold is higher (deeper) than the side wall 15 of the button 10. Push down pins 64B1 are provided, which press against the bottom face of the first bottom wall 51 when the secondary forming mold 65B is closed.

Then, with the second forming mold 65B closed (see FIG. 6(*e*)), molten resin, which is the same as that of the first bottom wall 51, is injected into the gap between the inner face of the recess 63B1 in the cavity mold and the side wall 15 of the button 10, and into the gap between the first bottom wall 51 and the core mold 64B. Then, the outer wall 41 and the second bottom wall 51A are integrally molded on the outer circumferential face of the side wall 15 of the button 10 and the bottom face of the first bottom wall 51 (secondary forming), and the push switch 1 is completed (see FIG. 6(*f*)). Note that impressions 51A1 are formed by the push down pins in the push switch of the present mode of embodiment (see FIG. 5), but the waterproofness within the button is not lowered by the impressions 51A1 of these pins.

Thus, in the second mode of embodiment as well, the outer circumferential face of the side wall 15 of the button 10 and the bottom face 20A of the switch substrate 20 are covered by integrally molded resin. Consequently, gaps do not form as was conventional, and the space within the cap shaped top operation part 11 in which the switch 30 is arranged is reliably sealed by the resin. Accordingly, even if water drops adhere to the push switch, the water drops will not adhere to the switch by way of the interior of the button, allowing for reliable waterproofing, which results in a reliable push switch.

Furthermore, the outer circumferential face of the side wall 15 of the button 10 and the bottom face 20A of the switch substrate are covered with resin. Consequently, there is no need for the work of injecting thermosetting resin as was conventional, and thus assembly time can be greatly reduced and productivity can be markedly improved.

Furthermore, the button 10 comprises a cap shaped top operation part 11, a flat part 14 that is formed extending laterally from the opening end of the top operation part 11, and a side wall 15 that is formed extending downwards from the outer edge of the flat part 14.

Furthermore, the switch substrate 20 abuts a bottom face 14B of the flat part of the button 10, and is fitted in close contact with the inner circumference of the side wall 15 of the button 10.

With such a configuration, when the first bottom wall 51 is molded from resin (primary forming), the pressurized molten resin flows onto the bottom face (in the opening of the button) by way of injection molding. At this point, the pressure of the molten resin is applied to the primary forming mold (cavity mold 63A) via the switch substrate, deforming the flat part of the button. Consequently, because the bottom face of the flat part 14 of the button 10 and the periphery of the switch substrate 20 are pressed together, the molten resin does not enter the top operation part 11 of the button 10.

Furthermore, when the outer wall 41 and the second bottom wall 51A are molded from resin (secondary forming), upon closing the secondary forming mold, the push down pins 64B1 push against the secondary forming mold (cavity mold 63B), via the first bottom wall 51, deforming the flat part 14 of the button 10. Consequently, the top face 14A of the flat part of the button 10 is pressed against the cavity mold 63B. Thus, when the pressurized molten resin is injected into the space between the inner face of the recess 63B1 of the cavity mold and the side wall 15 of the button 10 by way of injection molding, molding can be accomplished without resin burrs forming between the top face 14A of the flat part of the button 10 and the cavity mold 63B.

Accordingly, molding can be performed with high reproducibility, allowing a highly reliable waterproof push switch to be produced.

Furthermore, to describe the present mode of embodiment in more concrete terms, the bottom edge of the side wall 15 of the button 10 extends further downward than the switch substrate 20 and the switch substrate 20 is surrounded by the opening 13 in the button 10. Then, resin is integrally molded in the opening 13 in the button 10 on the bottom face 20A of the switch substrate. Consequently, the side of the first bottom wall 51 can reliably adhere to the interior of the opening in the button (inner face of the side wall 15), so that waterproofness can be further improved. Furthermore, because the button side wall is trapped between the first bottom wall 51 and the outer wall 41, the soft button can be reliably fixed in place.

Third Mode of Embodiment

Figure 7:
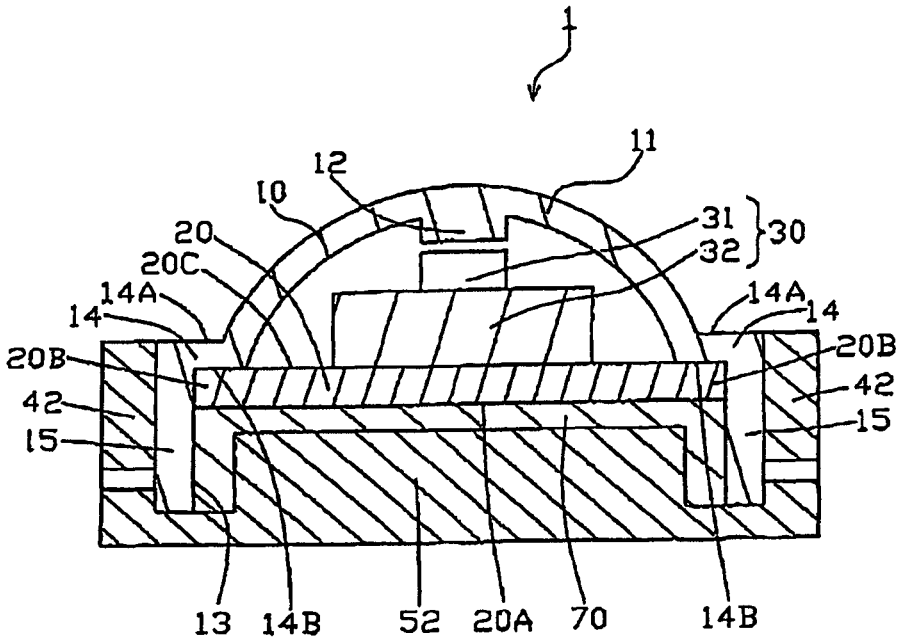
FIG. 7 is a sectional view of a push switch according to a third mode embodiment of the present invention.

FIG. 7 is a sectional view of a push switch according to a third mode embodiment of the present invention.

Figure 8:
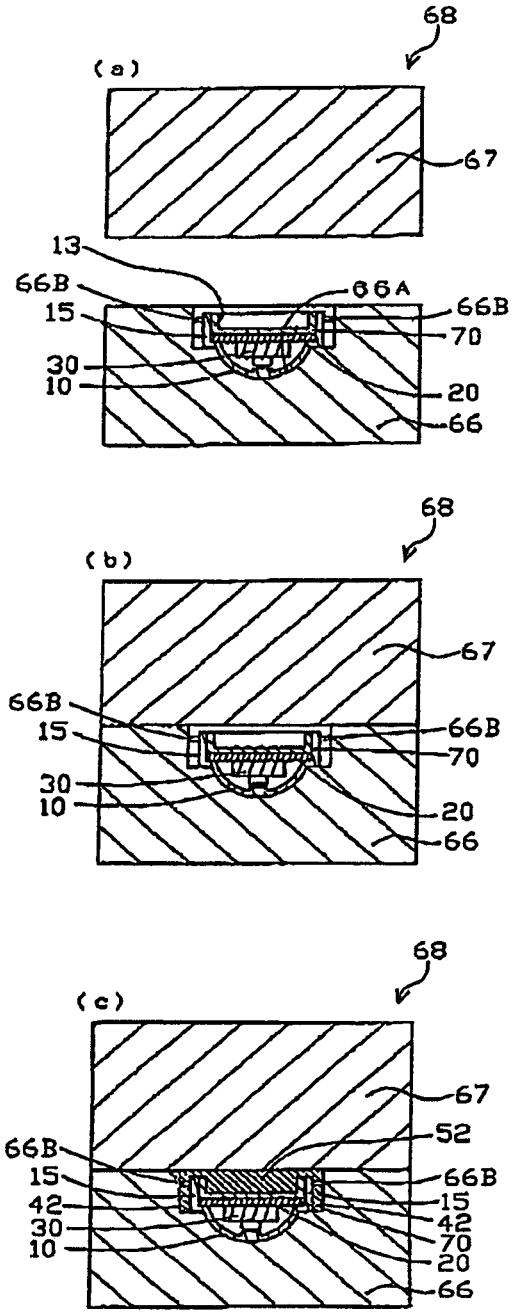
FIG. 8 consists of sectional views showing the manufacturing steps for the push switch according to the third mode embodiment of the present invention.

FIG. 8(*a*) is a sectional view showing the situation in which the button bearing the switch substrate has been inserted into the forming mold according to the third mode of embodiment of the present invention. FIG. 8(*b*) is a sectional view of the situation in which the forming mold according to the third mode of embodiment of the present invention has been closed. FIG. 8(*c*) is a sectional view of the situation in which the resin has been injected into the forming mold according to the third mode of embodiment of the present invention. In FIG. 7 and FIG. 8, identical reference numerals have been used for components identical to those in the first mode of embodiment, and redundant description of the same has been omitted.

The differences between the present mode of embodiment and the first mode of embodiment will be explained. In the first mode of embodiment, the button 10, in which the switch substrate 20 is arranged, is inserted into the primary forming mold 62A, and the outer wall 40 is integrally molded at the external circumferential face of the side wall 15 of the button 10. Then, this button 10 is inserted into the secondary forming mold 62B, and the bottom wall 50 is integrally molded on the bottom face 20A of the switch substrate. Conversely, in the present mode of embodiment, after arranging the switch substrate 20 bearing the switch 30 in the button 10, a stopper 70 is fitted on the bottom face 20A of the switch substrate in this button 10. Then, the button 10, into which the stopper 70 has been fitted, is inserted into the forming mold 68. Then, the outer wall 42 and the bottom wall 52 are integrally molded from molten resin at the outer circumferential face of the side wall 15 of the button 10 and the bottom face of the stopper 70 (bottom of the switch substrate 20).

Next, the assembly procedure for the push switch 1 of this mode of embodiment is described.

First, the lead wires 33 are soldered to the switch substrate 20 bearing the switch 30. Then, the switch substrate 20 bearing the switch 30 is arranged inside the button 10. In addition, the bottomed rectangular cylinder shaped stopper 70 is fitted and fixed in place on the bottom face of the switch substrate 20 of the button 10. The outer shape of this stopper 70 is substantially the same as the inner shape of the side wall of the button 10. The bottom end (opening end) of the stopper 70 is of a height that is substantially the same as that of the opening end of the opening 13 in the button 10, when the bottomed portion of the stopper 70 is fitted (abutted) on the bottom face 20A of the switch substrate. Because of this stopper 70, when the side wall 15 of the button 10 is molded from resin, the side wall 15 will not deform toward the interior of the button.

Then, the button 10 is inserted into the forming mold 68, which comprises a cavity mold 66 and a core mold 67, and can be opened and closed (see FIG. 8(*a*)). The bottom of a recess 66A in this cavity mold is the same shape as the top operation part 11 of the button 10, and the inner face of the recess 66 A in the cavity mold is larger than the outer circumferential face of the side wall 15 of the button 10. Furthermore, the bottom of the core mold 67, which contacts the cavity mold 66, is flat.

Furthermore, the height (depth) of the recess 66A in the cavity mold is higher than the side wall 15 of the button 10, when the top operation part 11 of the button 10 is fitted in the bottom of the recess 66A in the cavity mold (see FIG. 8(*a*)). Protruding pins 66B that can protrude into the recess 66A are provided on the inner face of the recess 66A in the cavity mold. The protruding pins 66B can abut the outer circumferential face of the side wall 15. As a result of these protruding pins 66B, when the side wall 15 of the button 10 is molded from resin, outward deformation of the button does not occur. The protruding pins 66B can be withdrawn into the inner face of the recess 66A after resin molding so that the button 10 can be taken out of the cavity mold 66.

Then, the forming mold 68 is closed (see FIG. 8(*b*)), and the molten resin flows into the gap between the inner face of the recess 66A in the cavity mold and the side wall 15 of the button 10, and into the gap between the bottom face of the stopper 70 and the core mold 67. Thus, the outer wall 42 and the bottom wall 52 are integrally molded from resin at the outer circumferential face of the side wall 15 of the button 10 and the bottom face of the stopper 70 (region below the switch substrate).

Thus, in the third mode of embodiment as well, the outer circumferential face of the side wall 15 of the button 10 and the bottom face of the stopper 70 (region below the switch substrate) are covered by resin so that gaps do not form, as was conventional. Furthermore, the space within the cap shaped top operation part 11, in which the switch 30 is arranged, is reliably sealed by the resin. Accordingly, even if water drops adhere to the push switch, the water drops will not adhere to the switch by way of the interior of the button, allowing for reliable waterproofing, which results in a reliable push switch.

Furthermore, the outer circumferential face of the side wall 15 of the button 10 and the bottom face of the stopper 70 (region below the switch substrate) are covered with resin. Consequently, there is no need for the work of injecting thermosetting resin, as was conventional, and thus the time required for assembly work can be greatly reduced and productivity can be markedly improved.

Furthermore, the button 10 comprises a cap shaped top operation part 11, a flat part 14 that is formed extending laterally from the opening end of the top operation part 11, and a side wall 15 that is formed extending downwards from the outer edge of the flat part 14. Furthermore, the switch substrate 20 abuts a bottom face 14B of the flat part of the button 10, and is fitted in close contact with the inner circumference of the side wall of the button.

With such a configuration, when the outer wall 42 and the bottom wall 52 are molded from resin, upon the pressurized molten resin flowing onto the bottom face of the stopper 70 by way of injection molding, the pressure of the molten resin is applied to the stopper 70. This pressure is applied to the forming mold (cavity mold 66) through the switch substrate 20, via the stopper 70, deforming the flat part 14 of the button 10. Thus, the top face 14A of the flat part of the button 10 is pressed against the cavity mold 66.

Accordingly, when the pressurized molten resin flows into the space between the inner face of the recess in the cavity mold and the side wall of the button, by way of injection molding, molding can be achieved without forming resin burrs between the top face of the flat part of the button and the cavity mold. Accordingly, molding can be performed with high reproducibility, allowing a highly reliable waterproof push switch to be produced.

Furthermore, with the present mode of embodiment, manufacturing costs can be greatly reduced as compared to the first mode of embodiment and the second mode of embodiment, as the resin molding can be performed with one forming mold.

Furthermore, to describe the present mode of embodiment in more concrete terms, the bottom edge of the side wall 15 of the button 10 extends further downward than the switch substrate 20. Furthermore, the switch substrate 20 is surrounded by the opening 13 in the button 10, and the bottomed rectangular cylinder shaped stopper 70 is fitted on the bottom face 20A of the switch substrate in the button 20. Accordingly, the side wall of the button can be molded from resin without inward deformation.

Figure 9:
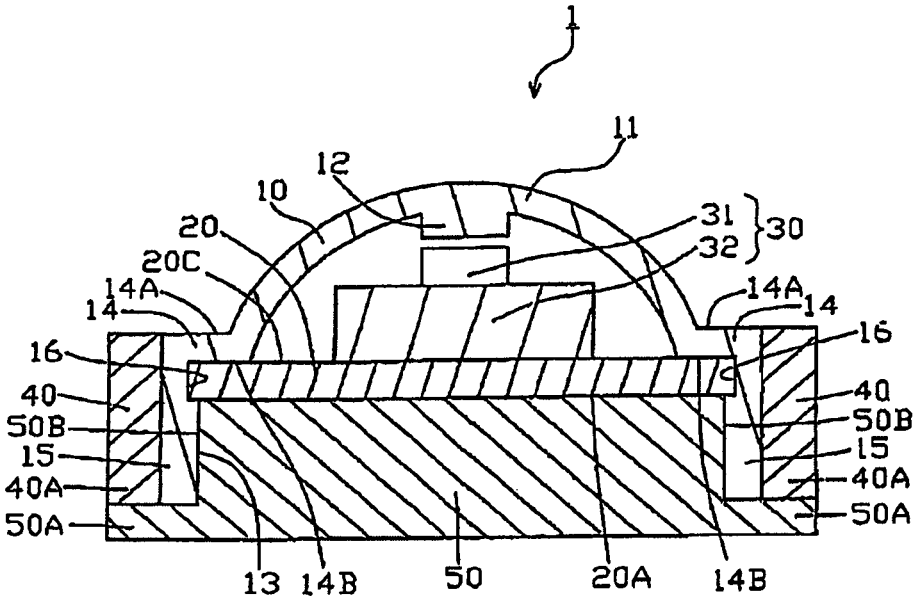
FIG. 9 shows a variant of the button of the present invention.
Figure 10:
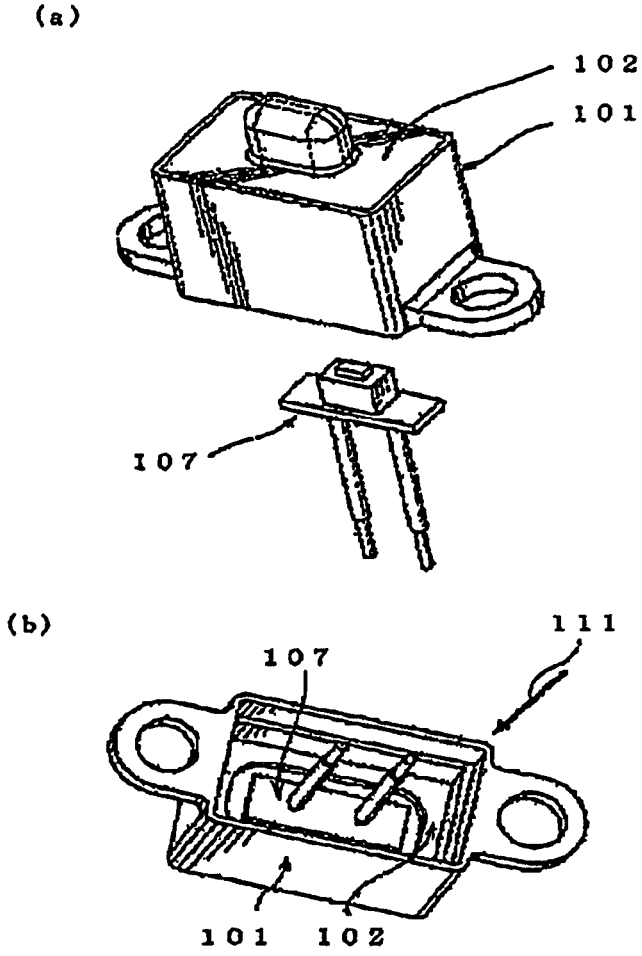
FIG. 10(*a*) is a perspective assembly view of a conventional push switch.

Note that, in the foregoing description, the external shape of the switch substrate was the same as the inner shape of the opening in the button, and the switch substrate was fitted abutting the flat part in the button. Here, the configuration may be such that a groove 16 is provided on the inner circumference of the button (side wall), and the periphery of the switch substrate is fitted into this groove 16, as shown in FIG. 9. If this is the case, molding can be performed with exceptionally high reproducibility, without the molten resin entering the space within the cap shaped top operation part when resin molding is performed, so that a push switch with more highly reliable waterproofing can be produced.

Furthermore, integral molding of the resin is performed with the lead wires 33 mentioned above inserted into escape grooves in the cavity mold or the core mold, which are not illustrated. Accordingly, the lead wires will not be pinched even when the forming mold is closed.

Furthermore, the resin used for molding in the second mode of embodiment and the third mode of embodiment can be the resin described in the first mode of embodiment. Furthermore, in the first mode of embodiment and the second mode of embodiment, it was explained that the same resin was used in the primary forming and the secondary forming, but different resins may be used for the primary forming and the secondary forming in the first mode of embodiment and the second mode of embodiment.

What is claimed is:

1. A push switch comprising:

a button made of a flexible material having a cap shaped top operation part, a flat part formed extending laterally from an edge of an opening in said top operation part, and a side wall formed extending downward from an outer edge of said flat part;

a switch substrate fitted in close contact with an inner circumference of said side wall and abutting a bottom face of the flat part of said button; and a switch arranged inside said button on said switch substrate; and wherein an outer circumferential face of the side wall of said button and a bottom face of said switch substrate or a region below said switch substrate are covered by integrally molded resin:

wherein a bottom edge of the side wall of said button extends further downward than said switch substrate;

wherein the outer peripheral face of the sidewall of said button is covered by an outer wall made from resin;

wherein the bottom face of said switch substrate is covered by a bottom wall made from resin, and the side face of said bottom wall of said switch substrate is in close contact with an inside face of said button sidewall; and wherein said outer wall and said bottom wall are connected, and the sidewall of said button is trapped by said bottom wall and said outer wall.

2. The push switch recited in claim 1, wherein the bottom face of said switch substrate abuts said bottom wall made from resin along an entire area of the bottom face of the switch substrate.

3. The push switch recited in claim 1, wherein the side wall formed extending downward from an outer edge of button is encased on all sides so that a bottom face extending further downward than said switch substrate, along with the inside face of said sidewall extending beyond the switch substrate, and the outer peripheral face of said sidewall are covered with said integrally molded resin.

4. A method of manufacturing the push switch recited in claim 1, comprising the steps of:

arranging said switch substrate bearing said switch within said button;

inserting said button, in which said switch substrate is arranged, into a primary forming mold, and integrally molding an outer wall at the external circumferential face of the side wall of said button; and inserting said button, wherein said outer wall has been integrally molded, into a secondary forming mold, and integrally molding a bottom wall on the bottom face of said switch substrate.

5. A method of manufacturing the push switch recited in claim 1, comprising the steps of:

arranging said switch substrate bearing said switch within said button;

inserting said button, in which said switch substrate is arranged, into a primary forming mold, and integrally molding a first bottom wall on the bottom face of said switch substrate; and inserting said button, wherein said first bottom wall has been integrally molded, into a secondary forming mold, and integrally molding an outer wall and a second bottom wall at the outer circumferential face of the side wall of said button and on the bottom face of said first bottom wall.

6. A method of manufacturing the push switch recited in claim 1, comprising the steps of:

arranging said switch substrate bearing said switch within said button;

fitting a stopper on the bottom face of said switch substrate within said button; and inserting said button, wherein said stopper has been fitted, into a forming mold, and integrally molding an outer wall and a bottom wall at the outer circumferential face of the side wall of said button and on the bottom face of said switch substrate.

* * * * *